US005203315A

United States Patent [19]

Clawson et al.

[11] Patent Number: 5,203,315

[45] Date of Patent: Apr. 20, 1993

[54] GAS CONVECTION OVEN WITH DUAL FUNCTION BURNER

[75] Inventors: Lawrence G. Clawson, Dover; Edward R. Cook, Northborough, both of Mass.

[73] Assignee: Raytheon Company, Lexington, Mass.

[21] Appl. No.: 931,750

[22] Filed: Aug. 18, 1992

[51] Int. Cl.[5] ..... A21B 1/00

[52] U.S. Cl. ..... 126/21 A; 126/19 R; 126/273 R

[58] Field of Search ..... 431/21 R, 21 A, 273 R, 431/273 A, 19 R

[56] References Cited

U.S. PATENT DOCUMENTS 3,363,662 1/1968 Curtis ..... 431/329

4,331,124 5/1982 Seidel et al. ..... 126/21 R 4,671,250 6/1987 Hurley et al. ..... 126/21 R

*Primary Examiner*—Carroll B. Dority

*Attorney, Agent, or Firm*—William R. Clark; Richard M. Sharkansky

[57] ABSTRACT

A gas convection oven having a radiant burner and fuel feeding apparatus which enables the single burner to be operated in either a broil mode or a bake mode. In the broil mode, the radiant burner is operated in conventional manner with the flame being held by an inner screen to heat the outer screen to a radiant luminous temperature. In the bake mode, forced air is injected into the burner by a fan thereby providing a leaner fuel-air mixture with higher velocity. As a result, the flame burns outside the outer screen of the burner with the outer screen serving as a flame holder. Therefore, hot combustion gases as produced while the outer screen remains non-luminous.

16 Claims, 3 Drawing Sheets

GAS CONVECTION OVEN WITH DUAL FUNCTION BURNER

BACKGROUND OF THE INVENTION

This invention generally relates to gas ovens, and more particularly relates to burner apparatus and method for alternately operating such burner apparatus in two different modes in a gas convection oven.

As described in U.S. Pat. No. 4,598,691, it is common for a gas oven to have two burners. One of the burners, which is commonly referred to as the bake burner, is typically a tubular ported burner that is housed in a burner box or combustion chamber located near or below the floor of the oven cavity. Hot products of combustion from the bake burner flow either directly into the oven cavity, or are used to heat a baffle which provides heat to the oven cavity. In such a manner, the oven cavity is heated to a predetermined baking temperature such as, for example 200°-550° F., and foods are baked therein. The bake burner may also be used in a self-clean mode of operation.

The second burner, which is commonly referred to as a broil burner, is typically located at or adjacent to the top of the oven cavity. One type of prior art broil burner is a radiant burner that has a burner head with spaced inner and outer screens covering the underside. The fuel-air mixture is introduced into the burner head and issues through the inner screen where it is ignited. In particular, the inner screen acts as a flame holder, and the flame burns on or through the outer screen thereby heating it to a predetermined luminous temperature. In turn, the outer screen gives off radiant energy that propagates downardly to broil the upper surface of food. Thus, a significant portion of the sensible heat of the flame is used to heat the outer screen which then produces a high level of radiant energy to broil food.

The above-described arrangement is relatively expensive to fabricate because two burners are used. In an attempt to provide both bake and broil modes of operation in a less expensive gas oven, a single burner has been used at the bottom of the oven cavity. The broiling is then accomplished in a separate drawer underneath the main oven cavity so that the burner is above the food. This approach, however, has a number of drawbacks. First, the normal storage space underneath the oven is lost because this region is used for the broil drawer. Also, the broil drawer is relatively low and therefore inconvenient to access. Further, a conventional tubular burner is typically used because it also provides the baking mode, and it is less effective as a broil burner.

SUMMARY OF THE INVENTION

In accordance with the invention, fuel feeding apparatus enables a conventional radiant burner having inner and outer screens to be operated in an alternate bake mode wherein, instead of the inner screen holding the flame to heat the outer screen to a luminous radiant temperature, the outer screen holds the flame which burns outside the outer screen. The fuel feeding apparatus includes a fan which operates in both the broil and bake modes, and a shutter which permits the resulting forced flow of air to be injected into the burner in only the bake mode. Therefore, in the bake mode, the fuel air mixture is leaner and the velocity greater to lift the flame off the inner screen and move it outside the outer screen.

One embodiment of the invention includes a gas oven comprising a cooking chamber, a burner operatively coupled to the cooking chamber and having a downwardly facing outer screen, and means for operating the burner in alternate first and second modes. In said first mode, the screen is heated to a predetermined temperature to produce radiant energy of a predetermined magnitude and, in the second mode, the screen serves as a flame holder to produce hot gases with the screen being at a temperature substantially below the predetermined temperature. It is preferable that the oven also be operated as a convection oven in both modes of operation.

With such arrangement, a single burner is used to alternately provide broiling and baking modes in a gas oven. Thus, the cost and complexity of a second bake burner is eliminated. In the broil mode, the radiant burner is operated in conventional manner with the flame held by the inner screen thereby heating the outer screen. In the bake mode, the fuel air mixture is made leaner and the velocity is greater to cause the flame to burn outside the outer screen.

BRIEF DESCRIPTION OF THE DRAWINGS

The foregoing features of this invention, as well as the invention itself, may be more fully understood from the following detailed description of the drawings, in which.

DESCRIPTION OF THE PREFERRED EMBODIMENTS

Figure 1:
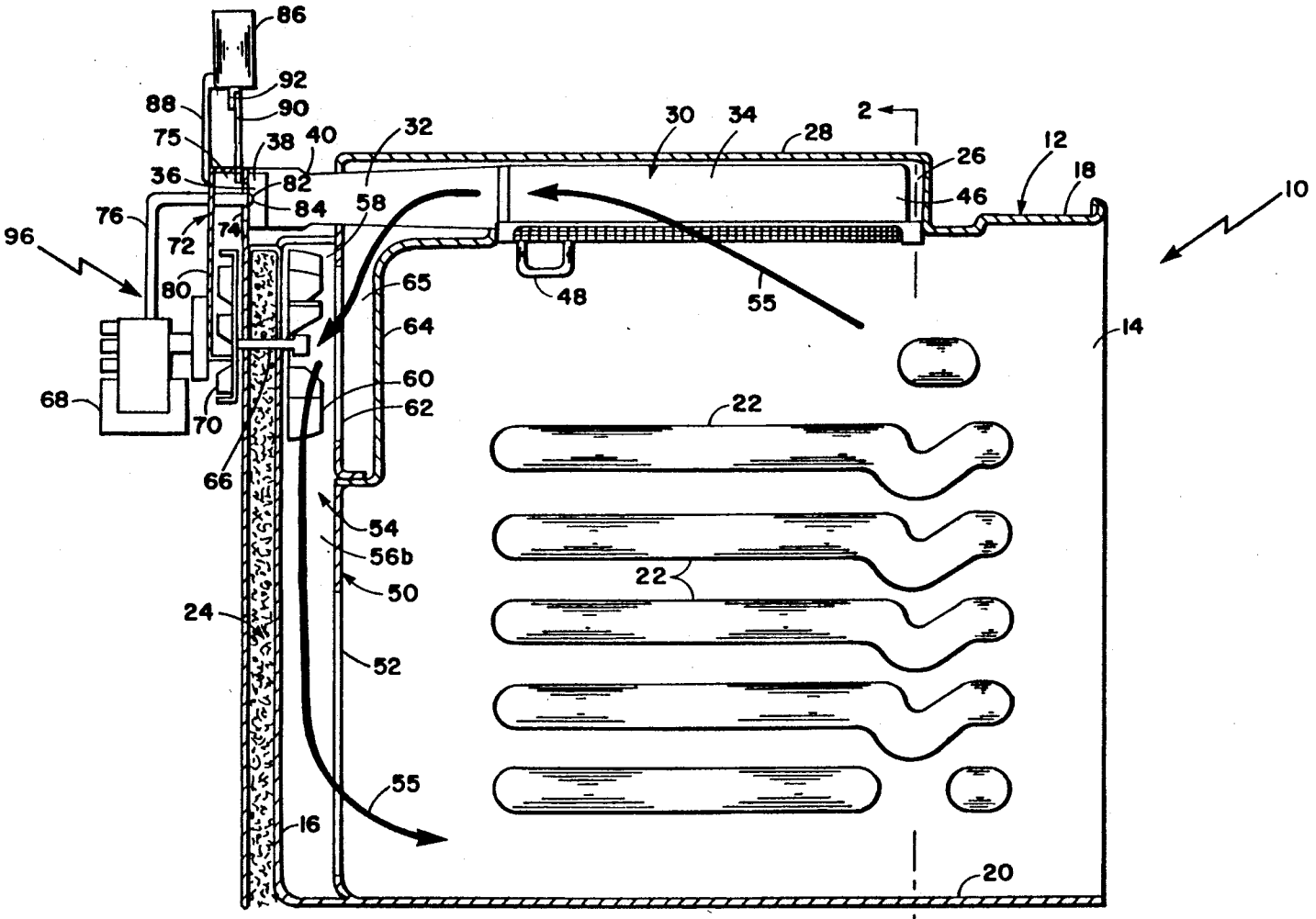
FIG. 1 is a side-sectional view of a convection oven with a dual-mode burner.
Figure 2:
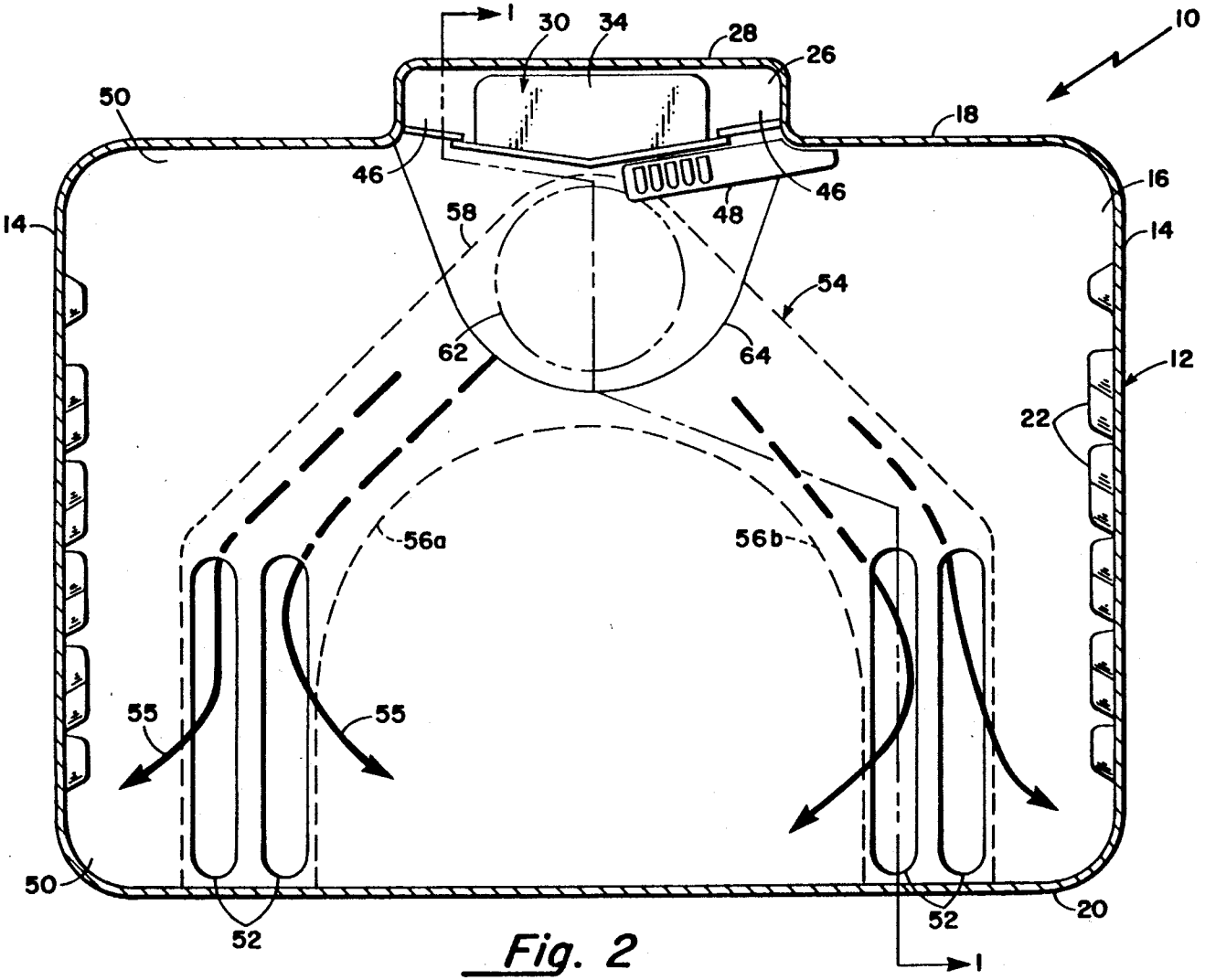
FIG. 2 is a front-sectional view of the oven cavity of FIG. 1.

Referring to the drawings wherein like numerals refer to like parts throughout the several views, oven 10 as here shown may typically be embodied in a free-standing gas range, or adapted for use in a built-in wall oven. With reference to FIGS. 1 and 2, oven 10 here includes a generally box-shaped metal liner or oven cavity 12 which is generally formed by side walls 14, back wall 16, ceiling 18, floor 20, and a door (not shown). Ceiling 18 has a conventional vent (not shown) for exhausting air from oven cavity 12. Side walls 14 are contoured to form guides 22 from which oven racks (not shown) are supported. As is conventional, at least a substantial portion of oven cavity 12 is surrounded by a layer of insulation 24.

Figure 4:
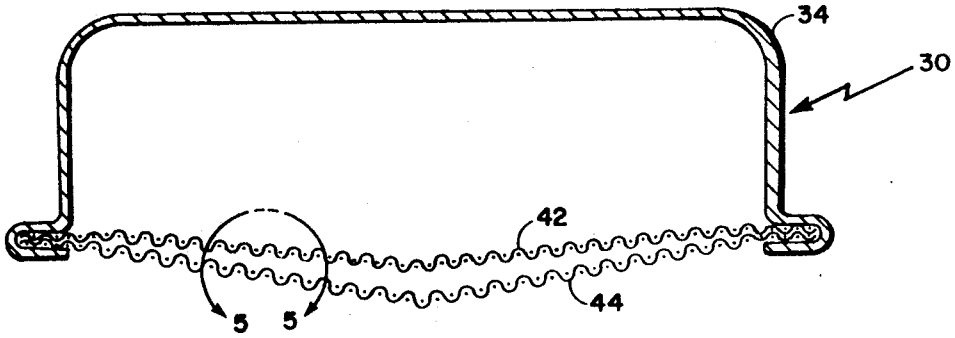
FIG. 4 is a front-sectional view of the dual-mode burner.

Still referring to FIGS. 1 and 2, ceiling 18 or top wall has a central front to back recess 26 that is formed by burner box 28 and houses burner 30. In particular, burner 30 is conventional and includes a throat 32 and a burner head 34. The rearward end 36 of throat 32 is open, and air inlets 38 are circumferentially cut adjacent thereto. A venturi 40 is formed in front of air inlets 38, and the front end of throat 32 is connected to head 34. As is shown best in FIG. 4, burner head 34 is hollow and has an inner screen 42 spaced from an outer screen 44 on the underside thereof. Although a metal grid is typically disposed between screens 42 and 44 to keep them spaced, the grid is not shown here to simplify the illustration. Burner 30 is elongated from front to back, and as shown best in FIG. 2, burner 30 is closely spaced to burner box 28 at the top, but longitudinal front to back channels 46 are provided along each side. A conventional igniter 48 of any suitable type is disposed along the underside of a portion of burner 30.

Still referring to FIGS. 1 and 2, a partition 50 is positioned in spaced relationship from backwall 16. Partition 50 has four vertically elongated apertures or outlet ports 52 disposed from the bottom thereof. Duct 54, which is formed behind partition 50, has two branches 56*a* and 56*b* each of which leads from an upper curved region 58 through two respective outlet ports 52 to the oven cavity 12 or cooking chamber. Convectional fan or impeller 60 is disposed in the upper curved region 58 of duct 54, and an aperture 62 is disposed in partition 50 in front of impeller 60. Aperture 60 is covered by a casing 64 or enclosure that provides a sealed passageway 65 from the rear of burner box 28 to aperture 62.

Impeller 60 is mounted on shaft 66 that extends through backwall 16 and insulation 24 to motor 68. A motor cooling fan or impeller 70 is mounted intermediate on shaft 66. Impeller 70 is partially encased by metal shroud 72 that extends up and covers the open end 36 of throat 32.

Figure 3:
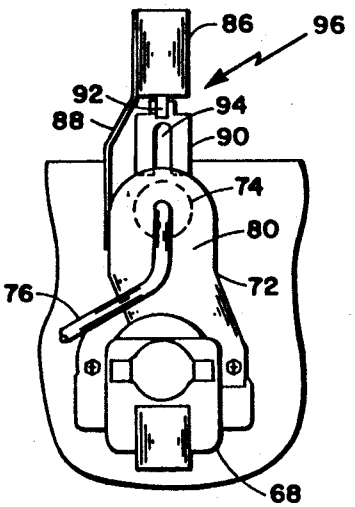
FIG. 3 is a rear view of the gas feed apparatus for the bake mode of operation.

Still referring to FIG. 1 and also to FIG. 3, a circular aperture 74 aligns with open end 36 of burner 30, and provides a passageway from the upper interior 75 of shroud 72 into the throat 32 of burner 30. The lower end of shroud 72 is open. The gas feedline 76 snugly fits through a corresponding hole in the rearward wall 80 of shroud 72 and extends through aperture 74 to a position disposed within the throat 32 of burner 30. Gas feedline 76 terminates in a spud 82 with an orifice 84. A solenoid 86 is mounted by bracket 88 above shroud 72, and a shutter 90 is connected to the plunger 92. More specifically, the shutter 90 extends through a slit (not shown) in the top of shroud 72, and has a central slot 94 with a semi-circular termination adapted for receiving the gas feedline 76 in sliding engagement.

Figure 5A:
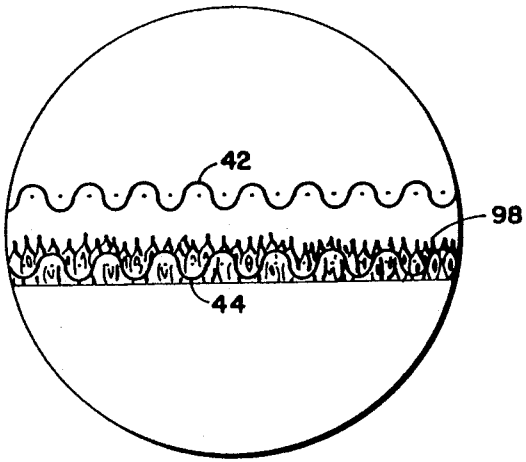
FIG. 5A is an expanded view of the 5—5 circle of FIG. 4 pictorially depicting the broil mode of operation.
Figure 6:
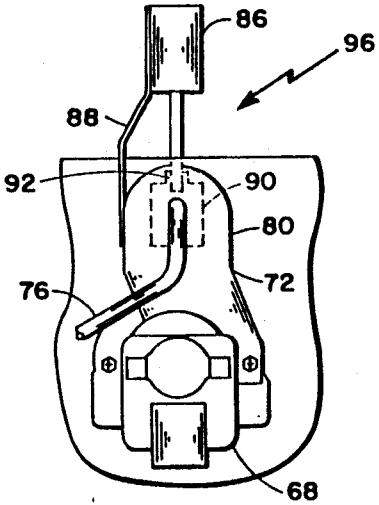
FIG. 6 is a rear view of the gas feed apparatus of FIG. 3 in the alternate broil mode of operation.

In accordance with the invention, gas feed apparatus 96 including impeller 60, shroud 72, solenoid 86, and shutter 90 enables burner 30 to be alternately operated in two different modes. More specifically, in the first mode of operation, burner 30 operates as a conventional radiant broil burner. In this mode, the state of solenoid 86 is such that plunger 92 and the connected shutter 90 are in the downward position as shown in FIG. 6. With such arrangement, shutter 90 surrounds gas feedline 76 and covers aperture 74. Thus, even though impeller 60 is rotated by motor 68 as will be described, the interior 75 of shroud 72 is isolated from the throat 32 of burner 30 by shutter 90 which functions as a removable flap. That is, the interior 75 of shroud 72 does not communicate with the throat 32 of burner 30 in this first operating mode. Therefore, in conventional manner, gas issuing from orifice 84 of spud 82 is injected down the throat 32 of burner 30 past the venturi 40 whereby combustion air is aspirated in through air inlets 38 to mix with the fuel. The air to fuel mixture which may, for example, typically be at a mass ratio of 17.5:1 moves forwardly into the burner head 34 and down through the inner screen 42 where it ignites. Under this conventional radiant burner operating condition, the inner screen 42 functions as a flame holder, and the flame burns on or down through the outer screen 44 as pictorially illustrated in FIG. 5A. That is, the flame 98 impinges on outer screen 44 thereby heating it to a luminous temperature such as, for example, 1200°-1600° F. At such luminous temperature, outer screen 44 gives off radiant energy which propagates downwardly to heat, or more particularly broil, the food below.

During this broil mode, motor 68 is activated to rotate impeller 60 which centrifugally drives the air from region 58 down the two branches 56*a* and 56*b* of duct 54, and into oven cavity 12 through respective outlet ports 52. The air 55 or combustion gases to impeller 60 is drawn from oven cavity 12 up into and rearwardly along channels 46, and downwardly through the sealed passageway 65 of casing 64 and through aperture 62. Thus, during the broil mode, air is convected up into burner box 28 and rearwardly through impeller 60 and downwardly behind partition 50 back into the oven cavity through outlet ports 52.

In the alternate mode of operation, the state of solenoid 86 is such that plunger 92 and shutter 90 are raised to the position shown in FIG. 3. Under such condition, the shutter 90 is removed from the position surrounding gas feedline 76, and aperture 74 is therefore open communicating from the interior 75 of shroud 72 into the open end of throat 32 of burner 30. In this condition, air which is forced centrifugally from impeller 70 up through shroud 72 is positively forced through aperture 74 into throat 32. This function of impeller 70 is in additional to its function of drawing air across motor 68 to provide cooling.

Figure 5B:
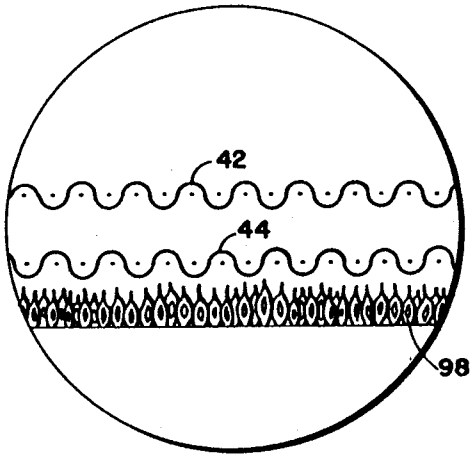
FIG. 5B is an expanded view of the 5—5 circle of FIG. 4 pictorially depicting the bake mode of operation.

The air injected by impeller 70 through aperture 74 into throat 32 increases the ratio of the air-fuel mixture. In particular, in this mode of operation, the air-to-fuel ratio may typically be 22:1. Thus, impeller 70 and shroud 72 enable burner 30 to operate as a power conversion burner wherein all, or nearly all, the combustion air is mixed with the gas as primary air under the forced draft of a fan. Under this condition, there is a relative lean dilute fuel-air mixture of higher volume or velocity. As a result, the flame speed lowers and the flame 98 lifts off the inner screen 42 and burns outside the outer screen 44 which now functions as a flame holder as shown in FIG. 5B. Therefore, the outer screen 44 is not heated to the luminous temperature as described with reference to FIG. 5A and the broil mode. For example, outer screen 44 may preferably be in the range 700°-800° F. The resulting flame is dilute blue. The air flow rate into burner 30 is a function of many parameters such as the characteristics of impeller 70, motor 68, shroud 72, burner 30, and cavity 12. These parameters may be adjusted empirically to attain an air flow rate that provides optimum flame characteristics.

Since neither flame nor outer screen 44 is luminous, radiant heat is relatively small. The combustion gases are convected through oven cavity 12 in the same manner described heretofore with regard to the broil mode. That is, the hot combustion gases 55 are drawn up into recess 26 and back along channels 46 and aperture 62 from which impeller 60 drives the hot combustion gases 55 down branches 56*a* and 56*b* of duct 54 and back into oven cavity 12 through outlet ports 52. This mode of operation is used to bake foods within the oven cavity 12. That is, in response to a temperature control (not shown) the oven cavity 12 or cooking chamber is heated to some predetermined set temperature such as, for example, 200° F.–550° F., and foods are cooked for some predetermined time period. This mode may also be used for self-cleaning oven cavity 12 by raising the temperature to approximately 1000° F. for a predetermined time period. The top of burner 30 is closely spaced to burner box 28 so very little convection air circulates over the top of burner 30. The temperature on top of burner 30 may be limited to approximately 650° F. during self-cleaning.

The recirculation of hot combustion gases 55 in the heretofore described manner provides uniform heating within the oven cavity 12 notwithstanding the use of cookie sheets or other flat cooking utensils on various shelves within the oven cavity 12. That is, the hot combustion air is introduced from the back of the oven cavity and flows forwardly and upwardly. Therefore, even cookies on an intermediate cookie sheet are directly subjected to the hot combustion gases 55.

In summary, a burner 30, here shown as a conventional radiant burner, may be operated in two alternate modes: broil and bake. Thus, both types of cooking operations can be attained effectively and efficiently in the same oven cavity 12 even though only one burner 30 is used. Although other types of arrangements could be used for selectively introducing forced combustion air into burner 30, the mode is here determined by the state of solenoid 86, and, more particularly, the location of shutter 90 connected to plunger 92. In the broil mode with the shutter 90 sealing the interior 75 of shroud 72 from the throat 32 of burner 30, burner 30 operates as a radiant burner in conventional manner. That is, the inner screen 42 operates as a flame holder to heat the outer screen 44 to a luminous temperature to provide radiant heat. In the bake mode, the shutter 90 is lifted or removed from the shroud 72, and the impeller 70 which cools motor 68 also provides a forced flow of air along the interior 75 of shroud 72 through aperture 74 into the throat 32 of burner 30. The increased velocity and leaner fuel-air mixture so induced causes the flame to burn outside the outer screen 44. Therefore, a relatively small portion of the sensible heat in the combustion gases is used to heat the outer screen 44. The outer screen 44 does not heat to a luminous temperature, and the hot combustion gases are recirculated in a convective bake mode.

Having described preferred embodiments of the invention, it will now become apparent to one of skill in the art that other embodiments incorporating their concepts may be used. It is felt, therefore, that these embodiments should not be limited to disclosed embodiments, but rather should be limited only by the spirit and scope of the appended claims.

What is claimed is:

1. A gas oven comprising:

a cooking chamber;

a burner operatively coupled to said cooking chamber, said burner having a downwardly facing outer screen; and means for operating said burner in alternate first and second modes wherein, in said first mode, said screen is heated to a predetermined temperature to produce radiant energy of a predetermined magnitude and, in said second mode, said screen serves as a flame holder to produce hot gases with said screen being at a temperature substantially below said predetermined temperature.

2. The oven recited in claim 1 wherein said burner further comprises a second screen disposed above said outer screen.

3. The oven recited in claim 2 wherein said operating means comprises means for introducing a fuel-air mixture into said burner to produce a flame that is held on said second screen and burns through said outer screen to heat said outer screen to said predetermined temperature in said first mode.

4. The oven recited in claim 2 wherein said operating means comprises means for introducing a second fuel-air mixture into said burner to produce a flame below said outer screen that is held on said outer screen to produce hot combustion gases in said second mode with said outer screen being at a temperature substantially below said predetermined temperature.

5. The oven recited in claim 1 wherein said operating means comprises means for heating said outer screen to a luminous temperature in said first mode.

6. The oven recited in claim 1 wherein said operating means comprises means for maintaining said outer screen at a nonluminous temperature in said second mode.

7. The oven recited in claim 4 wherein said operating means comprises means for introducing a flow of forced air into said burner to produce a leaner, higher velocity fuel-air mixture in said second mode than in said first mode.

8. A gas oven comprising:

a cooking chamber;

a burner operatively coupled to said cooking chamber, said burner having a downwardly facing outer screen;

means for introducing a first fuel-air mixture to operate said burner in a first mode and for alternately introducing a second fuel-air mixture to operate said burner in a second mode wherein, in said first mode, flame burns through said outer screen to heat said outer screen to a luminous temperature to produce radiant energy for broiling food in said cooking chamber and, in said second mode, flame burns outside said outer screen to produce hot combustion gases for baking food in said cooking chamber while said outer screen is nonluminous.

9. The oven recited in claim 8 wherein said burner further comprises a second screen disposed above said outer screen.

10. The oven recited in claim 9 wherein said operating means comprises means for introducing a fuel-air mixture into said burner to produce a flame that is held on said second screen and burns through said outer screen to heat said outer screen to said predetermined temperature in said first mode.

11. The oven recited in claim 9 wherein said operating means comprises means for introducing a second fuel-air mixture into said burner to produce a flame below said outer screen that is held on said outer screen to produce hot combustion gases in said second mode with said outer screen being at a temperature substantially below said predetermined temperature.

12. The oven recited in claim 8 wherein said operating means comprises means for introducing a flow of forced air into said burner to produce a leaner, higher velocity fuel-air mixture in the second mode than in the first mode.

13. The oven recited in claim 12 wherein said introducing means comprises an impeller positioned to force a flow of air into said burner.

14. The oven recited in claim 13 wherein said operating means comprises means for substantially reducing the flow of said forced air from said impeller to said burner in said first mode.

15. A gas oven comprising;

a cooking chamber;

a radiant burner comprising a cavity surrounded at least on the bottom side by an inner porous layer disposed in spaced relationship with an outer screen;

means for introducing a first fuel-air mixture at a first velocity into said burner in a first mode of operation to produce a flame that is substantially held by said porous layer and impinges on said outer screen to heat said outer screen to a luminous temperature to provide radiant heat for broiling food in said cooking chamber;

means comprising a fan impeller for introducing a second fuel-air mixture at a second velocity into said burner in an alternate second mode of operation to produce a flame that is substantially held below said outer screen by said outer screen to provide hot combustion gases for baking food in said cooking chamber while said outer screen is maintained at a nonluminous temperature.

16. A method of providing alternate first and second modes of operation with a radiant burner in a gas oven wherein the radiant burner has downwardly facing inner and an outer screens, comprising the steps of:

introducing a first fuel-air mixture at a first velocity into said burner to produce a flame that is substantially held by said inner screen and impinges said outer screen to heat said outer screen to a radiant luminous temperature; and alternately introducing a second fuel-air mixture at a second velocity into said burner to produce a flame that is substantially held by said outer screen, said second fuel-air mixture being leaner than said first fuel-air mixture and said second velocity being greater than said first velocity.

* * * * *